United States Patent [19]

Veness

[11] Patent Number: 4,844,208

[45] Date of Patent: Jul. 4, 1989

[54] LADDER EXTENSION DEVICE

[75] Inventor: Boyd L. Veness, Kamloops, B.C., Canada

[73] Assignee: 3V Enterprises Inc., Canada

[21] Appl. No.: 149,641

[22] Filed: Jan. 28, 1988

[30] Foreign Application Priority Data

Nov. 17, 1987 [CA] Canada ..... 552057

[51] Int. Cl.[4] ..... E06C 7/44

[52] U.S. Cl. ..... 182/201; 182/184; 248/188.8

[58] Field of Search ..... 182/201, 204, 205, 184; 248/246, 217.1, 217.3, 188.8, 218.4, 255.31, 231.3

[56] References Cited

U.S. PATENT DOCUMENTS

| | | | |
|---|---|---|---|
| 682,783 | 9/1901 | Brooks | 182/204 |
| 741,541 | 10/1903 | Phipps | 182/204 |
| 908,387 | 12/1908 | Boyd | 182/205 |
| 1,462,505 | 7/1923 | Hunt | 182/201 |
| 2,854,293 | 9/1958 | Riblet | 248/231.3 |
| 2,891,819 | 6/1959 | Jackson | 182/184 |
| 3,882,966 | 5/1975 | Fasano | 182/205 |
| 4,296,835 | 10/1981 | Koffski | 182/204 |
| 4,502,565 | 3/1985 | Koffski | 182/184 |

FOREIGN PATENT DOCUMENTS

| | | | |
|---|---|---|---|
| 195584 | 4/1938 | Switzerland | 182/205 |

*Primary Examiner*—Reinaldo P. Machado

*Attorney, Agent, or Firm*—Lerner, David, Littenberg, Krumholz & Mentlik

[57] ABSTRACT

A ladder accessory for releasably securing a wooden extension to a leg of a ladder comprises a metal channel member for receiving the ladder extension so as to allow longitudinal sliding adjustment of the extension relative to the channel member. A shaft rotatably mounted in opposed walls of the channel member carries a plurality of gripping pins and has a handle by which the pins can be rotated into indenting engagement with the extension for gripping and retaining the extension relative to the channel member, which is secured by a clamping device to the ladder leg. The handle rests against the extension below the shaft so as to prevent rotation of the shaft by the weight of the ladder.

3 Claims, 1 Drawing Sheet

LADDER EXTENSION DEVICE

FIELD OF THE INVENTION

The present invention relates to a ladder accessory for releasably securing a wooden extension to a leg of a ladder, e.g. for adapting the ladder to uneven ground or to a step or the like.

BACKGROUND OF THE INVENTION

Various ladder extensions have been proposed for this purpose in the past, as taught, for example, by U.S. Pat. No. 442,360, issued Dec. 9, 1890 to M. F. Coomes; U.S. Pat. No. 1,419,748, issued June 13, 1922 to L. M. Miller; U.S. Pat. No. 2,320,144, issued May 25, 1943 to E. Johnson; U.S. Pat. No. 2,481,581, issued Sept. 13, 1949 to E. Ehnhuus; U.S. Pat. No. 3,484,814, issued Dec. 19, 1969 to J. F. Meehan; U.S. Pat. No. 3,882,966, issued May 13, 1975 to Osvaldo Fasano and U.S. Pat. No. 4,412,599 issued Nov. 1, 1983 to Edward McCrudden et al. However, these prior ladder extensions have either had the disadvantage of being made of relatively expensive metal components and/or requiring such components to be provided on a metal ladder, or have had the disadvantage of relying on friction between the extension and a leg of the ladder to counteract displacement of the ladder leg relative to the extension in response to weight on the ladder.

BRIEF SUMMARY OF THE INVENTION

It is an object of the present invention to enable a ladder extension to be utilized which comprises wood, and also to effect improved engagement of the wood by indentation of the wood, in order to thus avoid mere frictional engagement of the extension.

According to the present invention, there is provided a ladder accessory for releasably securing a wooden extension to a leg of a ladder, comprising means for receiving the ladder extension in such a manner as to permit longitudinal sliding adjustment of the extension relative to the receiving means, means for releasably securing the receiving means to the ladder leg with the extension extending parallel to the ladder leg, and means for releasably retaining the extension against longitudinal movement thereof relative to the receiving means, the retaining means comprising manually operable means for operating the retaining means and projection means for indenting and thereby engaging the extension in response to actuation of the manually operable means.

BRIEF DESCRIPTION OF THE DRAWINGS

Further features, advantages and objects of the present invention will be more readily understood from the following description of a preferred embodiment thereof illustrated by way of example only in the accompanying drawing, in which.

DESCRIPTION OF THE PREFERRED EMBODIMENT

Figure 1:
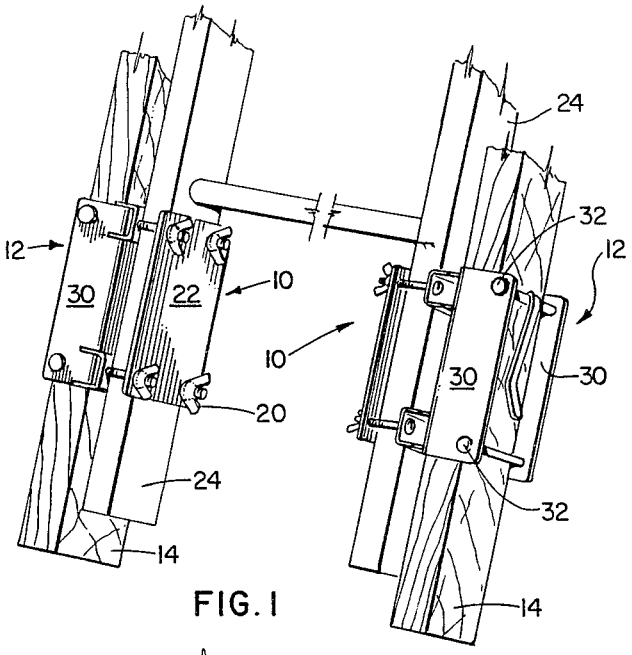
FIG. 1 shows a view in perspective of a pair of ladder extension accessories attached to the two legs of a ladder.

Referring now to the drawing, reference numeral 10 indicates generally a ladder extension accessory which comprises a main metal channel member indicated generally by reference numeral 12, made of sheet metal, which receives a length of wood 14 for forming a ladder leg extension.

A pair of smaller, transverse metal channels 16 are welded to the rear of the main metal 12, and are connected by bolts 18 and wing nuts 20 to a rectangular clamping plate 22. The bolts 18 extend through circular openings in the clamping plate 22 and the wing nuts 20, when tightened against the clamping plate 22, serve to clamp a ladder leg 24 between the clamping plate 22 and the transverse metal channels 16.

The bolts 18 extend through and engage in square openings (not shown) in the metal channels 16 so as to prevent rotation of the bolts 18 on tightening of the wing nuts 20.

A pair of shafts 26 and 28 extend through and between opposed side walls 30 of the main metal channel member 12, and are retained by heads 32 at the exterior of the metal channel member 12. The heads 32 of the shaft 26 are secured by welding to the side walls 30, while the heads 32 of the shaft 28 are free to rotate, together with the shaft 28, relative to the sidewalls 30.

Figure 2:
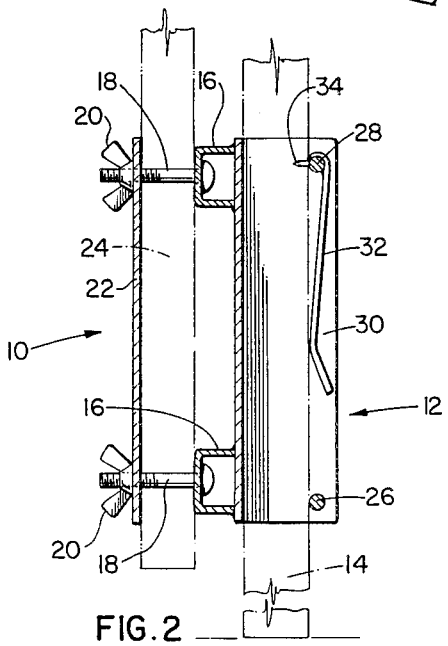
FIG. 2 shows a view taken in vertical cross-section through one of the ladder accessories of FIG. 1.

A handle 32 in the form of a bent length of metal strip is secured by welding at one end thereof to the rotatable shaft 28 and, when the shaft is in the position shown in FIG. 2, extends downwardly from the shaft 28 into abutment with the outer face of the wooden extension 14.

A plurality of pins 34 form projections from the shaft 28. In the preferred embodiment of the invention, there are four of the pins 34, which are spaced apart uniformly along the length of the shaft 28. The pins 34 serve to indent and penetrate, and thereby to engage and retain, the wooden extension 14 upon rotation of the shaft 28 is a clockwise direction, as viewed in FIG. 2, by means of the handle 32, until the handle 32 comes to rest against the outer face of the wooden extension 14 as shown in FIG. 2. The wooded extension 14 is thereby retained relative to the metal channel member 12 and, thus, relative to the ladder leg 24. Since the handle 32 rests against the wooden extension 14, the weight of the ladder, tending to push the ladder accessory 10 downwardly relative to the wooden extension 14, cannot effect further rotation of the shaft 28, and thus the pins 34, beyond the position shown in FIG. 2. To adjust the effective length of the extension, the weight of the ladder is preferably removed from the extension 14, and the handle 32 is then rotated in an anticlockwise direction, as viewed in FIG. 2, to release the pins 34 from the wooden extension 14, which can then be shifted longitudinally to its required position, whereupon the handle 32 is restored to the position shown in FIG. 2, causing the pins 34 to again penetrate and grip the extension 14.

I claim:

1. A ladder accessory for releasably securing a wooden extension to a leg of a ladder, comprising:

(a) receiving means for receiving said ladder extension in such a manner as to permit longitudinal sliding adjustment of said extension relative to said receiving means;

(b) securing means for releasably securing said receiving means to said ladder leg with said extension extending parallel to said ladder leg; and (c) retaining means for releasably retaining said extension against longitudinal movement thereof relative to said receiving means, said retaining means comprising manually operable means for operating said retaining means, penetration means for penetrating into said wooden extension thereby engaging said extension in response to actuation of said manually operable means, and a rotatable shaft supporting said penetration means for rotation into an engaged position in which said penetration means penetrates into and thereby engages said wooden extension, said manually operable means comprising a handle which abuts against said extension below said penetration means and thereby prevents further rotation of said penetration means by the weight of said ladder when said penetration means is in its engaged position.

2. The ladder accessory of claim 1 wherein said penetration means comprises a plurality of projecting pins on said shaft.

3. The ladder accessory of claim 2 wherein said receiving means comprises a metal channel member including a pair of opposite walls, and wherein said rotatable shaft is supported in said pair of opposite walls.

* * * * *